United States Patent [19]

La Grange

[11] 4,203,604

[45] May 20, 1980

[54] GOLF GAME

[76] Inventor: Mark La Grange, R.R. #51-Box 500, Terre Haute, Ind. 47805

[21] Appl. No.: 838,104

[22] Filed: Sep. 30, 1977

[51] Int. Cl.[2] ..... A63B 69/36

[52] U.S. Cl. ..... 273/176 FB; 273/180; 273/DIG. 5; 273/DIG. 13; 35/29 A

[58] Field of Search ..... 273/176 L, 176 F, 176 FB, 273/180, 245, 176 FC, 176 G, 176 H, 176 J, 178 R, 178 B, 195 A; 35/29 A

[56] References Cited

U.S. PATENT DOCUMENTS

| | | | |
|---|---|---|---|
| 1,403,345 | 1/1922 | Orr | 273/176 L |
| 1,687,217 | 10/1928 | Kurtz | 273/180 X |
| 1,761,039 | 6/1930 | Hazeltine | 273/176 H |
| 3,260,526 | 7/1966 | Seitz | 273/245 |
| 3,578,333 | 5/1971 | Elesh | 273/178 B |
| 3,603,594 | 9/1971 | Kelley | 273/176 F |
| 3,820,786 | 6/1974 | Candor | 273/176 L |
| 4,017,084 | 4/1977 | Jeffrey | 273/176 FB |

FOREIGN PATENT DOCUMENTS

| | | | |
|---|---|---|---|
| 1283461 | 7/1972 | United Kingdom | 273/178 B |

*Primary Examiner*—George J. Marlo
*Attorney, Agent, or Firm*—Robert D. Farkas

[57] ABSTRACT

A golf game utilizes an elongated, flexible mat having grass-like tufts extending outwardly from one lateral surface thereof. One end of the mat is provided with a plurality of openings therein simulating holes of a golf course. A number of card-holding containers are provided, each of which holds a number of playing-like cards containing typical golf situations and rules concerning them. The cards are used in conjunction with a scoring scheme testing the player's knowledge of golf rules and scoring the player thereon as well as scoring on the ability of a player to putt a golf ball into selected holes in the mat.

5 Claims, 3 Drawing Figures

GOLF GAME

BACKGROUND OF THE INVENTION

1. The Field of the Invention

This invention relates to games of skill and knowledge and more particularly to the class thereof involving the skill of putting a ball and the knowledge of the rules of the game of golf.

2. Description of the Prior Art

The prior art abounds with playing apparatuses utilized in playing the game of golf. For example, in one known device a flexible blanket is draped over one or several mounds to simulate a putting green. Provision is made for cups, completely contained in the putting green blanket in one embodiment, for insertion of the cups in underlying mounds in another. The blanket, mounds and cups can be quickly assembled on a table, or other suitable support and provision is made to grade the edges of the blanket to prevent resting of the ball along rails which contain the game. The blanket may also have a putting fringe surrounding the putting greens. By shifting these mounds, miniature versions of typical greens of any particular green can be formed. The mounds can also be made higher or lower. This apparatus is difficult to set up and use, as well as lacking in portability. Furthermore, actual putting cannot be practiced since the apparatus is adapted to have components suitable for playing purposes with miniature size clubs and balls.

Another known apparatus includes a rigid support and having thereon a pair of elongated cylinders disposed in spaced apart relationship and journaled for rotation along their parallel longitudinal axes. Indicia is carried upon the surface of an elongated sheet, each end of which is affixed to the periphery of the cylinders. One end of the table carries a miniature golf terrain-like surface adapted for use with portions of the indicia displayed on the flexible sheet carried by the cylinders. This apparatus, though versatile in appearance and in game possibilities, is expensive to manufacture and ill-suited for the actual use thereof as a full sized putting apparatus.

In yet another known device a driven golf ball rebounds from a vertically extending target panel having nine numbered target areas onto a putting area. The tee area has nine numbered tee positions and may be in the form of a grooved ramp which is inclined upwardly toward the target panel and has a progressively changing thickness from the first to the ninth tee position. The putting surface includes nine numbered ball receiving cups, each of which may be closed by a plug having an extracting bar spanning a concave cavity in the upper surface thereof. Such apparatus utilizes rigid components, limited in size, thereby prohibiting the use of the device in a full-fledged putting operation. Furthermore, the apparatus fails to teach a user thereof of any of the rules associated with the playing of the game of golf.

SUMMARY OF THE INVENTION

A primary object of the present invention is to provide a golf game which increases the skill of the user in the playing of full sized golf apparatus whilst increasing his knowledge of the rules of the game.

Another object of the present invention is to provide a golfing teaching aid, suitable for increasing a golfer's putting skills combined with a scoring procedure adapted to maintain the user's attention directed towards combining manual skills with knowledge of the rules of the game of golf.

Still another object of the present invention is to provide a portable apparatus, which may be easily assembled so as to represent a full putting green in length.

Yet another object of the present invention is to provide an apparatus which may be utilized by more than one player, or one player alone in a variety of competitive manual and mental sports, all related to the game of golf.

Heretofore, apparatuses have been utilized which simulate, in miniature fashion, golf games so as to permit a user thereof to mentally engage in the game of golf but failing to provide a practice area of sufficient size equivalent to the size of a game area actually used in the playing of golf. These devices also did nothing to assist a game player in his knowledge of the rules of the game of golf, which oft times require rote memory to retain the scoring rules of the game. The present invention, recognizes these difficulties and provides an apparatus which may be used by one or more persons to enhance putting skills on a full size basis, whilst permitting the apparatus to be easily transported from one location to another. The game may be played indoors or out and may be set up on a wide variety of terrains. The game employs a number of holes, each of which has a numerical hole identifier associated therewith. The grass-like appearance and texture of the flexible playing field simulates an actual putting green, thus enhancing the similarity to an actual playing field. A plurality of playing cards, when selected in accordance with the rules of the game, assist the user of the apparatus in testing his knowledge of the rules of golf. A scoring procedure, utilized in evaluating the player's putting skill and in testing the player's knowledge of the rules of golf, further increase the competitive aspects of playing the instant game.

These objects, as well as other objects of the present invention, will become more readily apparent after reading the following description of the accompanying drawings.

DESCRIPTION OF THE PREFERRED EMBODIMENT

Figure 3:
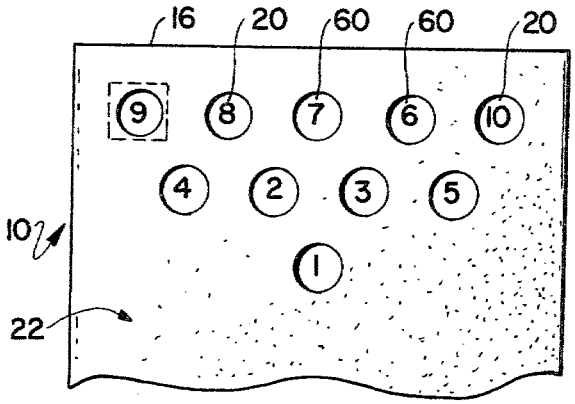
FIG. 3 is a plan view of a portion of the apparatus shown in FIG. 1.

The structure and method of fabrication of the present invention is applicable to an elongated rectangular flexible mat. The mat is provided having an uppermost lateral surface including upstanding filaments simulating blades of closely-cropped and evenly cut grass. The lowermost lateral surface comprises a uniformly flat surface. One end of the mat is provided with ten holes arranged so as to be in three rows, each row is aligned parallel to and spaced apart from adjacent rows as well as a short marginal edge of the mat. There are five holes closest to the short end of the mat. The next row, located intermediate to the first row and the center of the mat, is provided with four holes. The third row, contains only one hole which is most closely positioned to the center of the mat.

The mat may be fabricated from a flexible plastic-like material, such as polyvinyl chloride. Preferably, the mat should be finished having a green color. The mat may be twenty feet long by three foot wide and flexible enough so that it may be rolled up into a three foot long cylinder approximately eight to ten inches in diameter. A plurality of flexible, paper-like squares are adhered to the lowermost surface of the mat, utilizing an adhesive therefore, such that portions of the squares entirely cover the holes disposed adjacent one end of the mat. Numerical indicia is located on the uppermost surface of the flexible, paper-like squares, visually accessible through the hole as viewed from the top of the mat. A user, by standing at the other end of the mat, may putt a full sized golf ball along the length of the mat so as to direct the ball into preferred holes located at the other end of the mat. Four open ended boxes are provided, each containing a quantity of fifteen playing cards therein. Each box is identified by a sixteenth playing card therein carrying the numbers one, two, three, and four.

A typical game that may be played with the apparatus utilizes a single player whose object is to putt the ball into the lowest numbered cups. A player is permitted to strike the ball four times in succession. An opposing player reads the cards in accordance with a card selection scheme which is dependent upon the number of strokes the player has exercised. For example, if the golfing player has taken his third swing and succeeds in having the ball enter the cup carrying the number nine, then the card selected is taken from the third box and is numbered nine. In likewise fashion, if the golfing player has taken his fourth stroke and hits the cup carrying number two, then the card selected is in the fourth box and is the card carrying the number two. However, if the player doesn't succeed in having the ball land in any cup during a stroke, then the golfing player may select at random, any of the five unnumbered cards in the box carrying the number equivalent to the number of strokes taken so far. This card, as well as the other cards, contains a problem in scoring involving an actual game of golf, and the rule involving the scoring relating thereto. A wide variety of question and answer routines may be established between a golfing player and an opposing player so as to test the knowledge of either or both of them in answering the scoring rule for the situation fact pattern carried on each of the cards. A score card may be utilized to combine the ability of the golfing player to land a ball into a lowest numbered cup and to test the ability of the golfing player or his opponent on his knowledge of the rules of scoring of a golf game. Alternatively, the apparatus may be utilized as flash cards for purposes of testing a user in his knowledge of the game of golf. Another alternate use of the game is simply to permit golfing players, in alternate sequence, to attempt to match each other in succeeding in landing a golf ball in the same numerical cup as his predecessor. Other games may be played, such as by example to allow each player to play four successive strokes. The point value for the total of the four strokes, in which the ball has succeeded in landing, represents an individual player's total score for one round. Thus, each player has the opportunity to increase his skill in putting, to improve his knowledge of the rules of golf, and to engage in a competitive game in the process. The cards may be of a size equivalent to conventional playing cards or, if desired, may be substantially larger when utilized by golfing schools or golf pros as in teaching groups of novice golfers.

Figure 1:
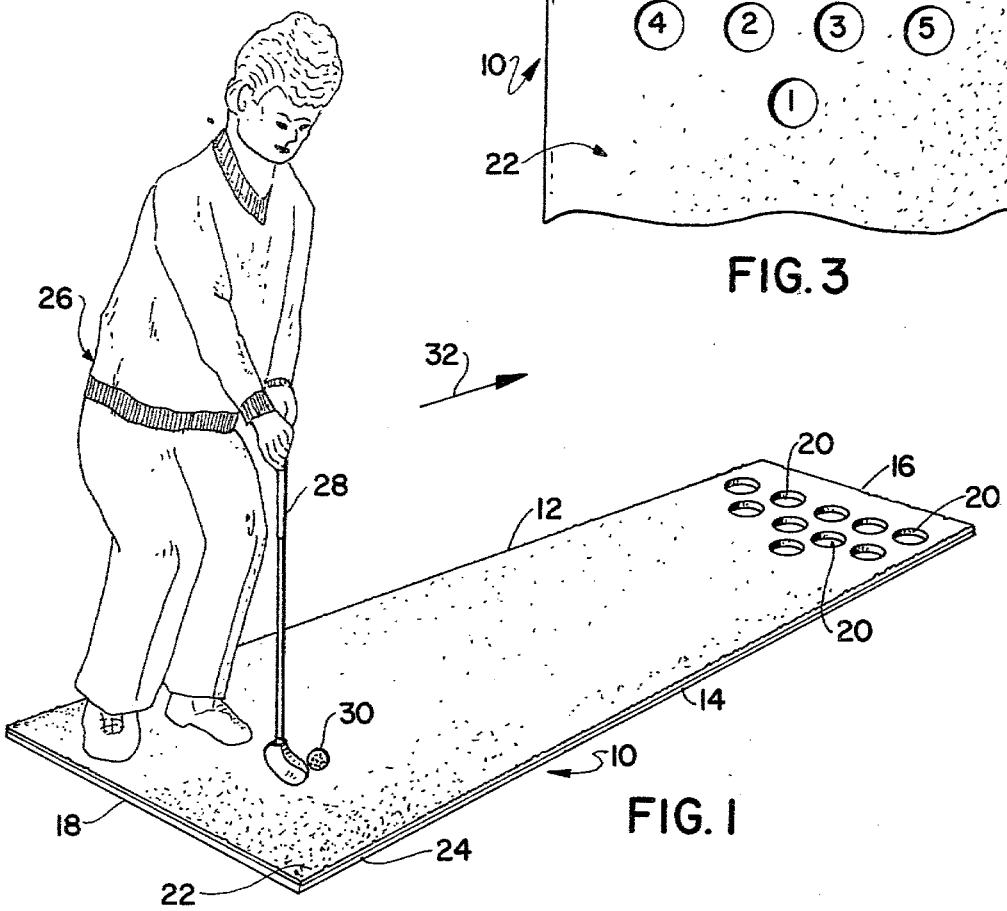
FIG. 1 is a perspective view of the mat portion of the present invention.

Now referring to the Figures, and more particularly to the embodiment illustrated in FIG. 1 showing the present invention mat portion 10 having rectangular sides 12, 14, 16, and 18. Side 16, is disposed in spaced apart parallel relationship with side 18, both having a length substantially shorter than sides 12 and 14, each extending parallel to the elongated major longitudinal axis of the apparatus. Holes 20 are shown located adjacent one end of the mat along side marginal edge 16 so as to be arranged in three rows. Mat 10 is shown having tuft-like blades 22 extending upwardly from a lowermost lateral surface 24. Golfer 26 is shown standing adjacent marginal edge 18 and is utilizing golf club 28 to strike golf ball 30 in the direction of arrow 32 so as to cause ball 30 to hopefully enter a selected hole 20.

Figure 2:
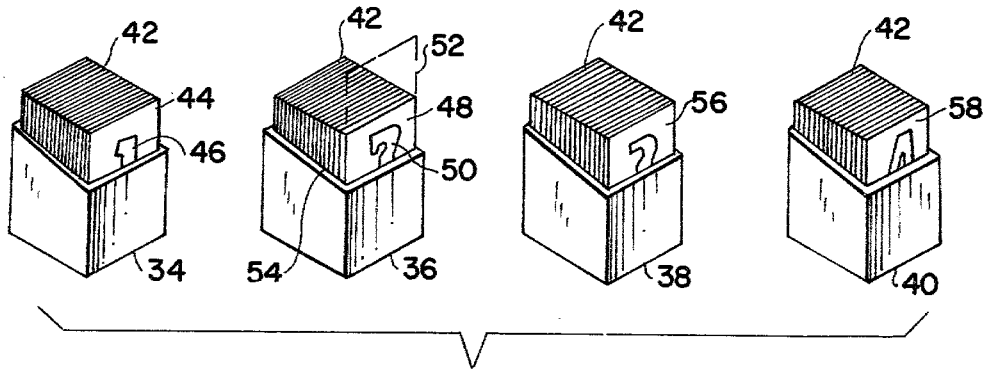
FIG. 2 is a perspective view of the boxes and playing cards useful as part of the present invention.

FIG. 2 illustrates boxes 34, 36, 38, and 40, each having playing cards 42 therein. Card 44 is disposed in the front of box 34 and is provided having indicia 46 thereon, representing numeral one. Card 48 is shown enclosed partially within box 36 and carries indicia 50 thereon, representing numeral two. Dotted lines 52 illustrate the position and upper position of card 48, when elevated above uppermost marginal edge 54 of box 36, when in a reading position. Similarly, cards 42 may be elevated upwardly from marginal edge 54, when it is desired to read the indicia disposed upon such cards. Cards 56 and 58 carry indicia representing numeral three and four respectively, whilst being contained within boxes 38 and 40 respectively.

Figure three illustrates holes 20 in which numerical indicia 60 may be visualized. Such holes are shown aligned so as to have numerals 9, 8, 7, 6, and 10 disposed in a row adjacent marginal edge 16. An adjacent row exposes numerals 4, 2, 3, and 5. The third centermost row displays numeral 1. Such indicia is carried by a paper-like rectangle, disposed secured the lowermost surface of the mat, such surface being opposite surface 22. Each rectangle is adhesively secured to the surface and carries indicia 60 disposed located within openings 20. Thus, mat 10 may be totally flexible in nature whilst providing a cuplike opening at each hole 20, whose base displays numerical indicia 60.

One of the advantages of the present invention is to provide a golf game which increases the skill of the user in the playing of full sized golf apparatus whilst increasing his knowledge of the rules of the game.

Another advantage of the present invention is to provide a golfing teaching aid, suitable for increasing a golfer's putting skills combined with a scoring procedure adapted to maintain the user's attention directed towards combining manual skills with knowledge of the rules of the game of golf.

Still another advantage of the present invention is to provide a portable apparatus, which may be easily assembled so as to represent a full putting green in length.

Yet another advantage of the present invention is to provide an apparatus which may be utilized by more than one player, or one player alone in a variety of competitive manual and mental sports, all related to the game of golf.

Thus there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A golf game comprising an elongated flexible mat, said mat having one lateral surface thereof including a plurality of upstanding blade-like bristles uniformly disposed along the entire said one lateral surface, each of said upstanding bristles simulating closely cropped and evenly cut grass, the other lateral surface of said mat being substantially smooth, a plurality of holes being located adjacent one marginal edge of said mat, a plurality of flexible sheets, said plurality of flexible sheets fixedly secured to said other lateral surface of said mat at the locations of said plurality of holes, said plurality of sheets each carrying indicia, said indicia being visibly accessible through said plurality of holes.

2. The apparatus as claimed in claim 1 wherein said mat comprises a plastic material.

3. The apparatus as claimed in claim 2 wherein said plastic material comprises polyvinyl chloride.

4. The apparatus as claimed in claim 1 wherein said mat has a rectangular shape.

5. The apparatus as claimed in claim 1 further comprising a plurality of boxes, each of said plurality of boxes including a plurality of playing cards, each of said plurality of playing cards carrying indicia, said indicia including writings relating to the game of golf.

* * * * *